US010203185B1

(12) United States Patent
Kitts

(10) Patent No.: US 10,203,185 B1
(45) Date of Patent: Feb. 12, 2019

(54) ARROW OUTSERT

(71) Applicant: Randy Kitts, Ball Ground, GA (US)

(72) Inventor: Randy Kitts, Ball Ground, GA (US)

( * ) Notice: Subject to any disclaimer, the term of this patent is extended or adjusted under 35 U.S.C. 154(b) by 0 days.

(21) Appl. No.: 16/012,801

(22) Filed: Jun. 20, 2018

(51) Int. Cl.
*F42B 6/08* (2006.01)
*F42B 6/04* (2006.01)

(52) U.S. Cl.
CPC . *F42B 6/04* (2013.01); *F42B 6/08* (2013.01)

(58) Field of Classification Search
CPC ..... F42B 6/08
See application file for complete search history.

(56) References Cited

U.S. PATENT DOCUMENTS 4,671,517 A 6/1987 Winters
5,611,542 A * 3/1997 Saunders ..... F42B 6/08 473/578
7,115,055 B2 * 10/2006 Palomaki ..... F42B 6/04 473/578
7,651,421 B2 * 1/2010 Smith ..... F42B 6/04 473/582
8,688,605 B2 * 4/2014 Adair ..... G06F 17/30345 706/21
9,410,773 B2 * 8/2016 Greenwood ..... F42B 6/04
9,638,499 B2 5/2017 Perry
9,739,581 B2 * 8/2017 Zobell ..... F42B 6/08
9,772,169 B2 * 9/2017 Greenwood ..... F42B 6/04
2009/0163308 A1 * 6/2009 Odabachian ..... F42B 6/08 473/582
2017/0299353 A1 * 10/2017 Greenwood ..... F42B 6/08

* cited by examiner

*Primary Examiner* — John Ricci
(74) *Attorney, Agent, or Firm* — Donald J. Ersler

(57) ABSTRACT

An arrow outsert preferably includes a base insert, a retention fastener and an outsert receiver. The base insert includes an elongated diameter and an end flange. The elongated diameter is inserted into an end of an arrow shaft. A plurality of circumferential slots are formed around the elongated diameter to receive a bonding substance. A threaded tap is formed in a flange end of the base insert to receive the retention fastener. The outsert receiver includes an elongated diameter and an outer tapered surface. An arrow shaft bore is formed in a tapered end of the outsert receiver to receive an outer perimeter of the arrow shaft. A fastener hole is formed in an end opposite the tapered end (tap end) to receive the retention fastener. An arrow point threaded tap is formed in the tap end of the outsert receiver to receive a thread rod of an arrow point.

16 Claims, 1 Drawing Sheet

ARROW OUTSERT

BACKGROUND OF THE INVENTION

1. Field of the Invention

The present invention relates generally to archery and more specifically to an arrow outsert, which allows an outsert receiver of an arrow outsert to be removably anchored to an arrow shaft with a fastener.

2. Discussion of the Prior Art

U.S. Pat. No. 4,671,517 to Winters discloses an apparatus for rotatably mounting arrowheads. U.S. Pat. No. 9,638,499 to Perry discloses an insert/outsert assembly for an arrow.

Accordingly, there is a clearly felt need in the art for an arrow outsert, which allows an outsert receiver of an arrow outsert to be removably anchored to an arrow shaft with a fastener and an arrow point to be threaded into the outsert receiver of the arrow outsert.

SUMMARY OF THE INVENTION

The present invention provides an arrow outsert, which allows an outsert receiver of an arrow outsert to be removably anchored to an arrow shaft with a fastener. The arrow outsert preferably includes a base insert, a retention fastener and an outsert receiver. The base insert includes an elongated insert diameter and an end flange. The end flange terminates one end of the elongated insert diameter. The elongated insert diameter is sized to be received by an inner diameter of an arrow shaft. A plurality of circumferential slots are preferably formed around the elongated insert diameter to receive a bonding substance. The bonding substance is used to secure the base insert to the inner diameter of the arrow shaft. A threaded tap is formed in a flange end of the base insert.

The retention fastener preferably includes a threaded outer diameter, a retention flange and a tool cavity portion. The threaded outer diameter extends from one end of the retention flange and the tool cavity portion extends from an opposing end of the retention flange. A tool cavity is formed in the tool cavity portion. The tool cavity may be a hex cavity, a Torx cavity or any other suitable tool cavity. The threaded outer diameter is sized to be threadably received by the threaded tap in the base insert.

The outsert receiver includes an elongated outsert diameter and an outer tapered surface formed on one end of said elongated outsert diameter. An arrow shaft bore is formed in a tapered end of the outsert receiver. The arrow shaft bore is sized to receive an outer diameter of the arrow shaft. A fastener hole is formed in an end opposite the tapered end (tap end) and through a bottom of the arrow shaft bore. An arrow point threaded tap is formed in the tap end of the outsert receiver. A minor diameter of the arrow point threaded tap is formed in the tap end to a depth, which allows the fastener hole to have a short length to support the retention flange of the retention fastener. The minor diameter is greater than an outer diameter of the retention flange of the retention fastener. A clearance bore is formed into tap end a short distance to allow insertion of a threaded rod of an arrow point or a broadhead.

The arrow outsert is preferably attached to an arrow in the following manner. A bonding agent, such as glue, adhesive, cement or any other suitable substance is placed in the plurality of circumferential slots of the base insert. The base insert is inserted into the inner diameter of the arrow shaft. After the bonding agent cures, the arrow shaft is inserted into the arrow shaft bore of the outsert receiver. The outsert receiver is secured to the arrow shaft by inserting the retention fastener into the clearance bore and tightening the retention fastener to the base insert. The threaded rod of an arrow point may now be threaded into the arrow point threaded tap.

Accordingly, it is an object of the present invention to provide an arrow outsert, which allows an outsert receiver of an arrow outsert to be removably anchored to an arrow shaft with a fastener and an arrow point to be threaded into the outsert receiver of the arrow outsert.

These and additional objects, advantages, features and benefits of the present invention will become apparent from the following specification.

DETAILED DESCRIPTION OF THE PREFERRED EMBODIMENTS

Figure 1:
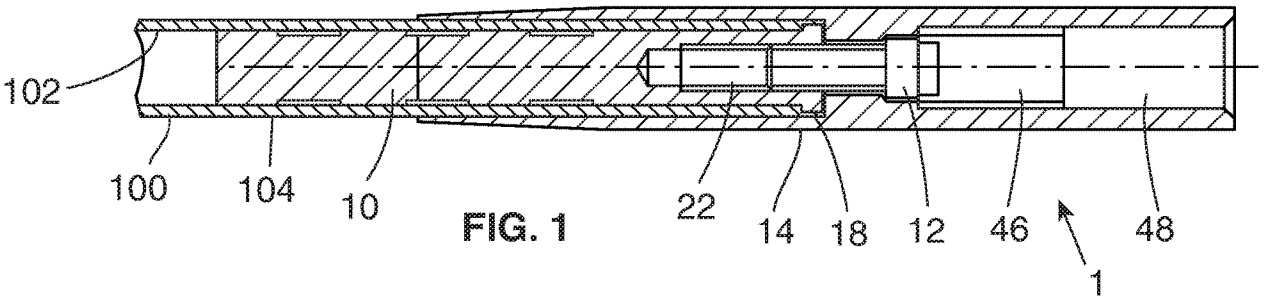
FIG. 1 is a cross sectional side view of an arrow outsert retained on an arrow shaft in accordance with the present invention.
Figure 3:
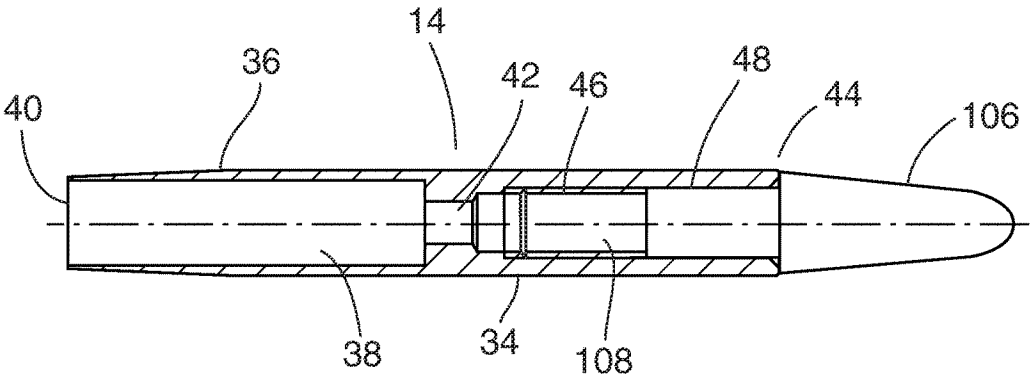
FIG. 3 is a cross sectional side view of an arrow point threaded into an outsert receiver of an arrow outsert in accordance with the present invention.
Figure 5:
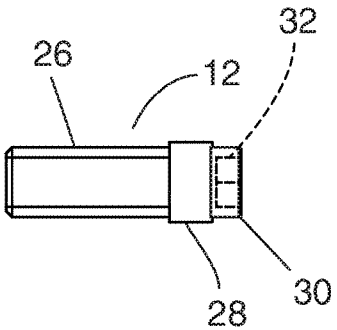
FIG. 5 is a side view of a retainer fastener of an arrow outsert in accordance with the present invention.
Figure 2:
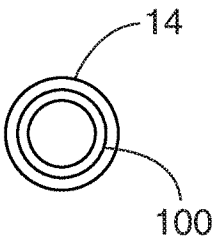
FIG. 2 is an end view of an arrow outsert in accordance with the present invention.
Figure 4:
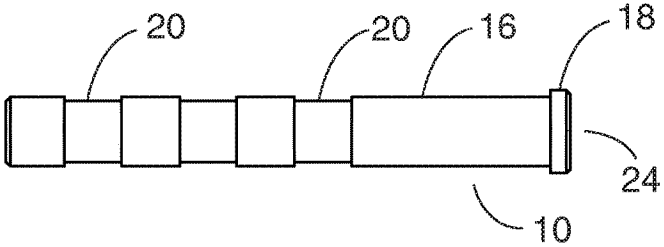
FIG. 4 is a side view of a base insert of an arrow outsert in accordance with the present invention.

With reference now to the drawings, and particularly to FIG. 1, there is shown a cross sectional view of an arrow outsert 1 retained on an arrow shaft 100. With reference to FIGS. 2-5, the arrow outsert 1 preferably includes a base insert 10, a retention fastener 12 and an outsert receiver 14. The base insert 10 includes an elongated insert diameter 16 and an end flange 18. The end flange 18 terminates one end of the elongated insert diameter 16. The elongated insert diameter 16 is sized to be received by an inner diameter 102 of an arrow shaft 100. A plurality of circumferential slots 20 are preferably formed around the elongated insert diameter 16 to receive a bonding substance. The bonding substance is used to secure the base insert 10 to the inner diameter 102 of the arrow shaft 100. A threaded tap 22 is formed in a flange end 24 of the base insert 10. The base insert is preferably fabricated from steel, but other materials may also be used.

The retention fastener 12 preferably includes a threaded outer diameter 26, a retention flange 28 and a tool cavity portion 30. The threaded outer diameter 26 extends from one end of the retention flange 28 and the tool cavity portion 30 extends from an opposing end of the retention flange 28. A tool cavity 32 is formed in the tool cavity portion 30. The tool cavity 32 may be a hex cavity, a Torx cavity or any other suitable tool cavity. The threaded outer diameter 26 is sized to be threadably received by the threaded tap 22 in the base insert 10.

The outsert receiver 14 includes an elongated outsert diameter 34 and an outer tapered surface 36 formed on one end of the elongated outsert diameter 34. An arrow shaft bore 38 is formed in a tapered end 40 of the outsert receiver 14. The arrow shaft bore 38 is sized to receive an outer diameter 104 of the arrow shaft 102. A fastener hole 42 is formed in an end opposite the tapered end 40 (tap end 44) and through a bottom of the arrow shaft bore 38. An arrow point threaded tap 46 is formed in the tap end 44 of the outsert receiver 14. A minor diameter of the arrow point threaded tap 46 is formed in the tap end 44 to a depth, which allows the fastener hole 42 to have a short length to support the retention flange 28 of the retention fastener 12. The minor diameter is greater than an outer diameter of the retention flange 28 of the retention fastener 12. A clearance bore 48 is formed in the tap end 44, a short distance to allow insertion of a threaded rod 108 of an arrow point 106. The outsert receiver 14 is fabricated from steel, aluminum, titanium, a non-metal high impact material or any other suitable material.

The arrow outsert 1 is preferably attached to the arrow shaft 100 in the following manner. A bonding agent, such as glue, adhesive, cement or any other suitable substance is placed in the plurality of circumferential slots 20 of the base insert 10. The base insert 10 is inserted into the inner diameter 102 of the arrow shaft 100. After the bonding agent cures, the arrow shaft 100 is inserted into the arrow shaft bore 38 of the outsert receiver 14. The outsert receiver 14 is secured to the arrow shaft 100 by inserting the retention fastener 12 into the clearance bore 48 and tightening the retention fastener 12 to the base insert 10. The threaded rod 108 of an arrow point 106 may now be threaded into the arrow point threaded tap 46.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An arrow outsert comprising:

a base insert includes an elongated insert diameter extending from an end flange, a retention threaded tap is formed in said end flange;

a retention fastener includes a threaded outer diameter extending from a retention flange; and an outsert receiver includes an elongated outsert diameter, an arrow shaft bore is formed in one end of said elongated outsert diameter, a fastener hole is formed through an opposite end of said elongated outsert diameter, an arrow point threaded tap is formed in said opposite end of said elongated outsert diameter, wherein said outsert receiver is secured to said base insert with said retention fastener.

2. The arrow outsert of claim 1 wherein:

an outer tapered surface is formed on said one end of said elongated outsert diameter.

3. The arrow outsert of claim 1 wherein:

a minor diameter of said arrow point threaded tap is formed in said opposite end of said elongated outsert diameter to a depth, which allows said fastener hole to have a short length.

4. The arrow outsert of claim 3 wherein:

said minor diameter is greater than an outer diameter of said retention flange of said retention fastener.

5. The arrow outsert of claim 1 wherein:

said outsert receiver is fabricated from steel, aluminum, titanium or a non-metal high impact material.

6. An arrow outsert comprising:

a base insert includes an elongated insert diameter extending from an end flange, a retention threaded tap is formed in said end flange;

a retention fastener includes a threaded outer diameter extending from a retention flange; and an outsert receiver includes an elongated outsert diameter, an arrow shaft bore is formed in said one end of said elongated outsert diameter, a fastener hole is formed through an opposite end of said elongated outsert diameter, an arrow point threaded tap is formed in said opposite end of said elongated outsert diameter, wherein said outsert receiver is secured to said base insert with said retention fastener, an arrow shaft is retained in said arrow shaft bore.

7. The arrow outsert of claim 6 wherein:

said arrow shaft is retained in said arrow shaft bore with a bonding agent.

8. The arrow outsert of claim 6 wherein:

an outer tapered surface is formed on said one end of said elongated outsert diameter.

9. The arrow outsert of claim 6 wherein:

a minor diameter of said arrow point threaded tap is formed in said opposite end of said elongated outsert diameter to a depth, which allows said fastener hole to have a short length.

10. The arrow outsert of claim 9 wherein:

said minor diameter is greater than an outer diameter of said retention flange of said retention fastener.

11. The arrow outsert of claim 6 wherein:

said outsert receiver is fabricated from steel, aluminum, titanium or a non-metal high impact material.

12. An arrow outsert comprising:

a base insert includes an elongated insert diameter extending from an end flange, a plurality of circumferential slots are formed on said elongated insert diameter, a retention threaded tap is formed in said end flange;

a retention fastener includes a threaded outer diameter extending from a retention flange; and an outsert receiver includes an elongated outsert diameter, an arrow shaft bore is formed in one end of said elongated outsert diameter, a fastener hole is formed through an opposite end of said elongated outsert diameter, an arrow point threaded tap is formed in said opposite end of said elongated outsert diameter, wherein said outsert receiver is secured to said base insert with said retention fastener.

13. The arrow outsert of claim 12 wherein:

an outer tapered surface is formed on said one end of said elongated outsert diameter.

14. The arrow outsert of claim 12 wherein:

a minor diameter of said arrow point threaded tap is formed in said opposite end of said elongated outsert diameter to a depth, which allows said fastener hole to have a short length.

15. The arrow outsert of claim 14 wherein:

said minor diameter is greater than an outer diameter of said retention flange of said retention fastener.

16. The arrow outsert of claim 12 wherein:

said outsert receiver is fabricated from steel, aluminum, titanium or a non-metal high impact material.

* * * * *